US007908695B2

(12) United States Patent
Budd et al.

(10) Patent No.: US 7,908,695 B2
(45) Date of Patent: Mar. 22, 2011

(54) MANUALLY-OPERATED RAMP FOR HANDICAPPED ACCESS

(75) Inventors: Alfred L. Budd, Winamac, IN (US); Jeffrey J. Hermanson, Culver, IN (US)

(73) Assignee: The Braun Corporation, Winamac, IN (US)

( * ) Notice: Subject to any disclaimer, the term of this patent is extended or adjusted under 35 U.S.C. 154(b) by 468 days.

(21) Appl. No.: 12/101,588

(22) Filed: Apr. 11, 2008

(65) Prior Publication Data

US 2009/0255067 A1 Oct. 15, 2009

(51) Int. Cl.
*E01D 1/00* (2006.01)

(52) U.S. Cl. ..... 14/71.3; 414/921

(58) Field of Classification Search ..... 14/69.5, 14/71.1, 71.3; 414/921
See application file for complete search history.

(56) References Cited

U.S. PATENT DOCUMENTS 2,607,937 A * 8/1952 Stone ..... 14/69.5
3,486,181 A * 12/1969 Beckwith et al. ..... 14/71.3
3,516,103 A * 6/1970 Beckwith et al. ..... 14/71.3
3,747,354 A * 7/1973 Macomber ..... 405/220
3,879,784 A * 4/1975 Kummerman ..... 14/71.1
4,265,586 A * 5/1981 Couture ..... 414/545
4,935,979 A * 6/1990 Walker et al. ..... 14/71.1
5,195,205 A * 3/1993 Cook ..... 14/71.1
5,214,818 A * 6/1993 Cook ..... 14/71.1
5,253,410 A * 10/1993 Mortenson ..... 29/436
5,343,583 A * 9/1994 Cook ..... 14/71.3
6,442,783 B1 * 9/2002 Yoon et al. ..... 14/71.1
2003/0210976 A1 * 11/2003 Koretsky ..... 414/537

* cited by examiner

*Primary Examiner* — Gary S Hartmann
(74) *Attorney, Agent, or Firm* — Michael Best & Friedrich LLP

(57) ABSTRACT

A manually operated ramp assembly includes a ramp platform and a drive assembly. The ramp platform is moveable between a stowed position and a deployed position, and the drive assembly is coupled to and affords movement of the ramp platform. A shaft extends away from the drive assembly and defines a shaft axis. The shaft is coupled to the drive assembly to cause movement of the ramp platform between the stowed position and the deployed position in response to rotation of the shaft about the shaft axis. A handle is disposed at a distal end of the shaft for manual rotation of the shaft about the shaft axis. A biasing member biases the ramp platform toward the stowed position.

18 Claims, 8 Drawing Sheets

MANUALLY-OPERATED RAMP FOR HANDICAPPED ACCESS

BACKGROUND OF THE INVENTION

The present invention relates generally to access ramps, and more specifically to manually-operated ramps for handicapped access.

To enhance the lives of mobility-impaired individuals, lifts, ramps, and other devices are known for providing access to vehicles such as vans, minivans, buses, and the like to those confined to wheelchairs or mobility scooters. For example, lifts are sometimes installed in the doorway of a full-sized van or bus. Lifts generally include a platform that is moveable from the ground surface to the floor level of the van or bus. Power for moving the platform is usually provided by electric motors or hydraulic cylinders.

Often, the lower vehicle floor height provided by minivans and similar vehicles allows ramps to be installed instead of lifts. Different types of ramps include folding ramps, swing-out ramps, and ramps that are stored within a cassette provided in the floor of the vehicle. Each type of ramp is generally moveable between a deployed position for providing access to the vehicle, and a stowed position where the ramp is moved to a position inside the vehicle structure. Ramps can be moved between the stowed and deployed positions automatically or manually. Automatic ramps generally use electric motors, hydraulics, or pneumatics to move the ramp between the stowed and deployed positions. Manually operated ramps are generally stowed or deployed by grasping the ramp itself.

SUMMARY OF THE INVENTION

In some embodiments, the invention provides a manually operated ramp assembly that includes a ramp platform and a drive assembly. The ramp platform is moveable between a stowed position and a deployed position, and the drive assembly is coupled to and affords movement of the ramp platform. A shaft extends away from the drive assembly and defines a shaft axis. The shaft is coupled to the drive assembly to cause movement of the ramp platform between the stowed position and the deployed position in response to rotation of the shaft about the shaft axis. A handle is disposed at a distal end of the shaft for manual rotation of the shaft about the shaft axis. A biasing member biases the ramp platform toward the stowed position.

Figure 1:
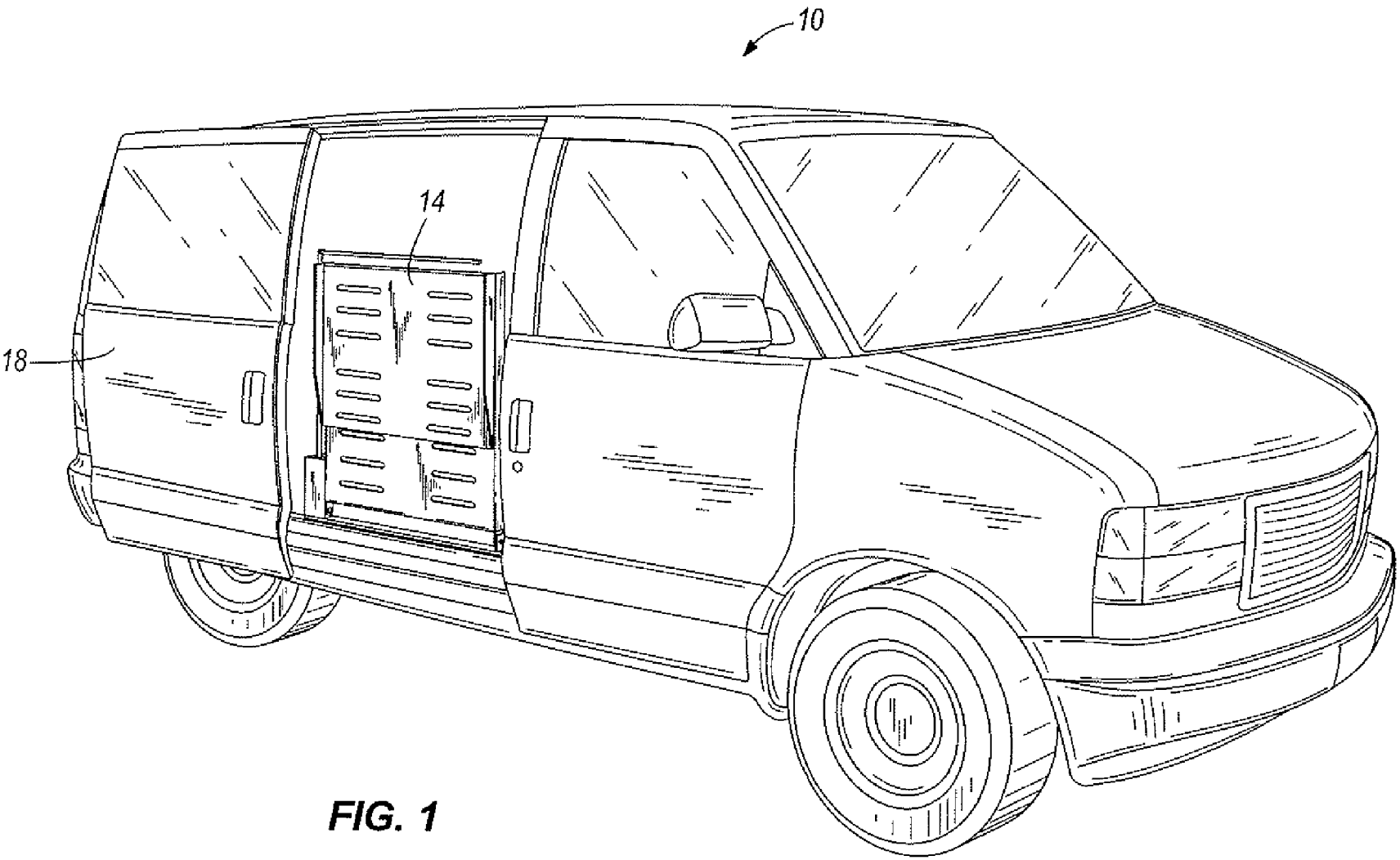
FIG. 1 is perspective view of a vehicle including a manually operated ramp assembly embodying the invention.

Before at least one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways.

DETAILED DESCRIPTION

FIG. 1 illustrates a minivan 10 into which a manually operated ramp assembly 14 embodying the invention has been installed. While FIG. 1 illustrates the ramp assembly 14 installed in the doorway of a passenger side sliding door 18, the ramp assembly 14 can also be installed in a vehicle liftgate opening or driver side sliding doorway. Furthermore, the ramp assembly 14 can be installed in other types of vehicles, or can be adapted for other uses or applications that may not involve vehicles at all.

Figure 2:
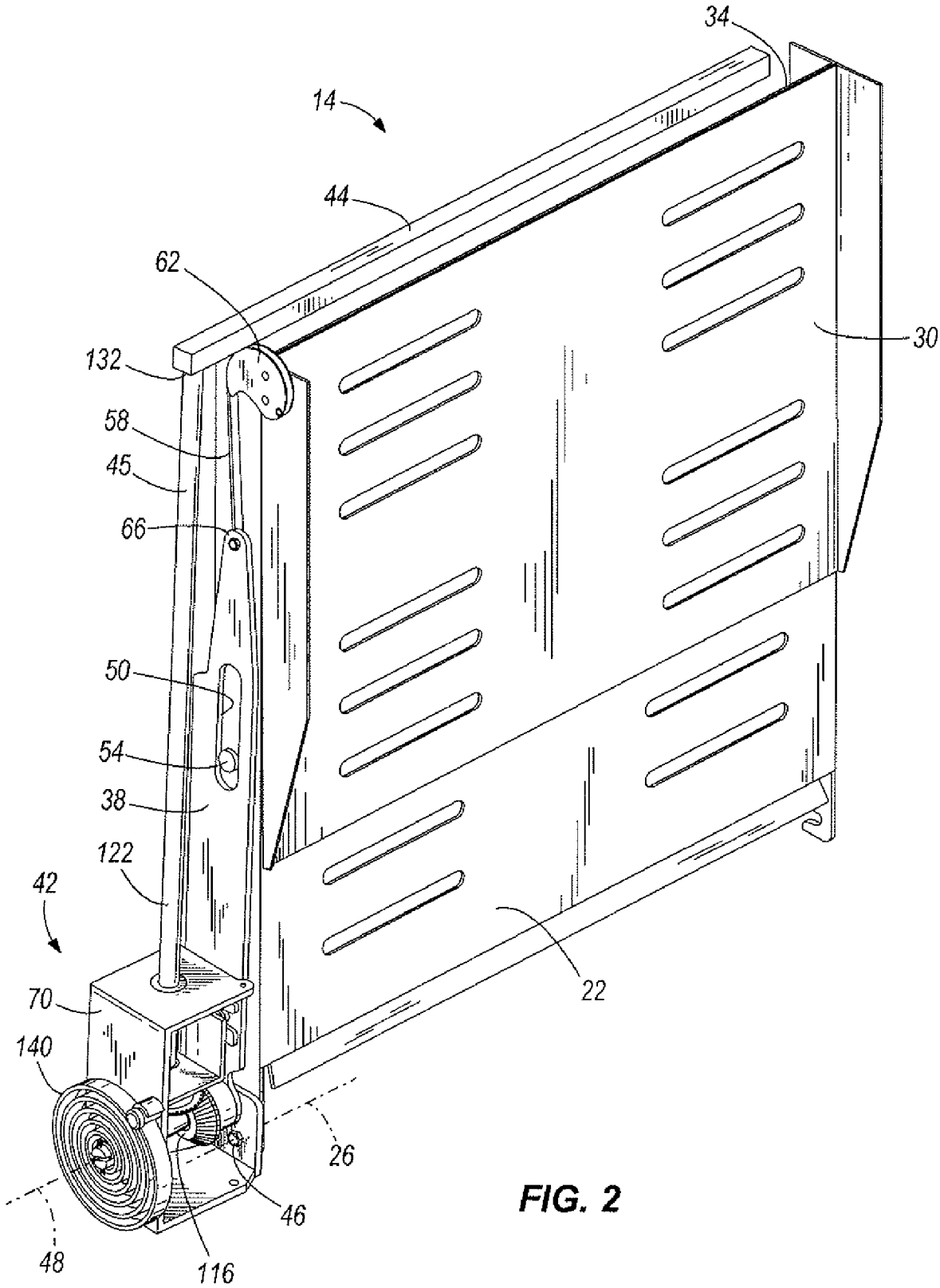
FIG. 2 is a perspective view of the manually operated ramp assembly of FIG. 1 in a stowed position.
Figure 3:
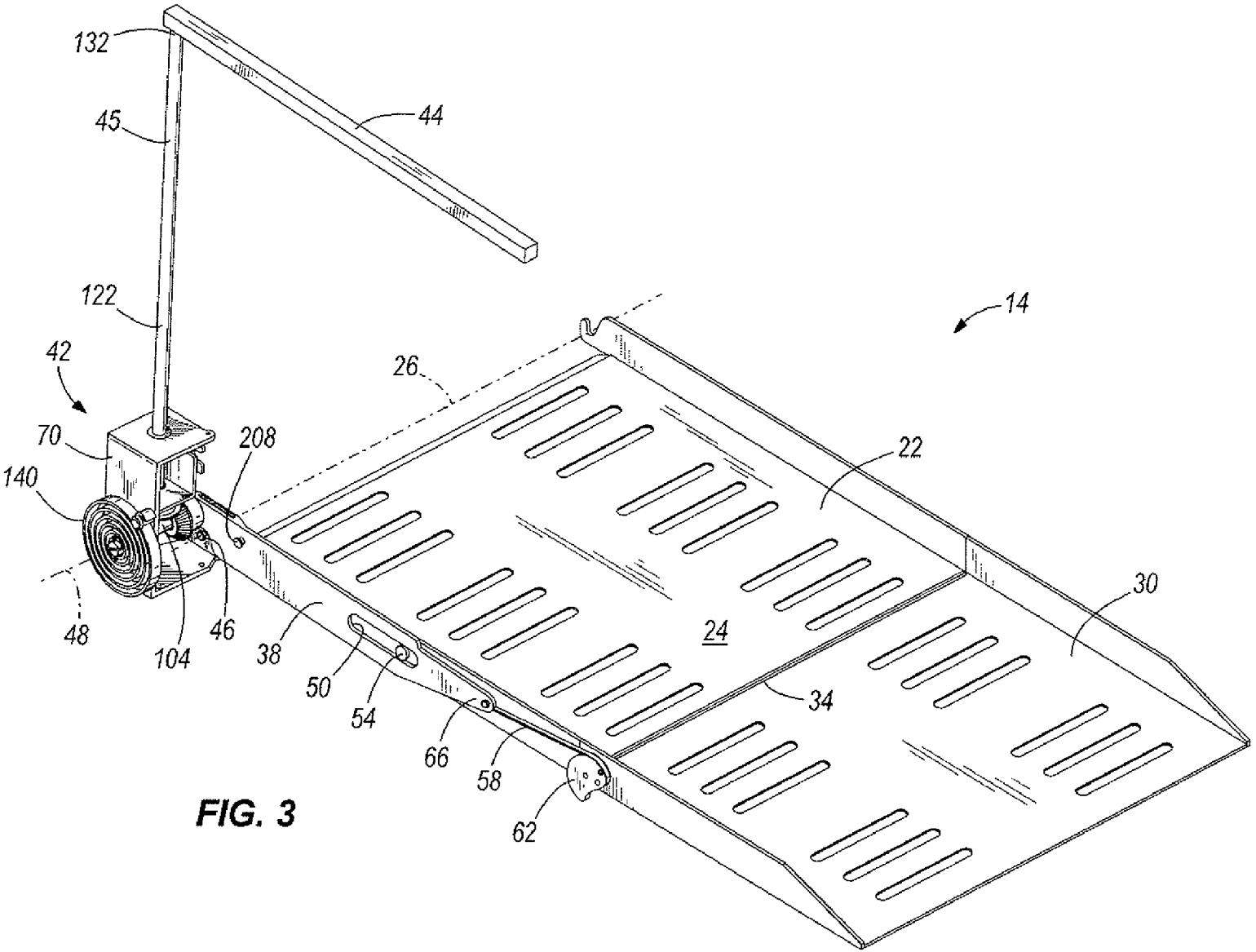
FIG. 3 is a perspective view of the manually operated ramp assembly of FIG. 1 in a deployed position.

FIGS. 2 and 3 illustrate the ramp assembly 14 in greater detail. FIG. 2 illustrates the ramp assembly 14 in a stowed position, which allows the sliding door 1 8 of the vehicle 10 to be closed. FIG. 3 illustrates the ramp assembly 14 in a deployed position, which allows wheelchair bound or other mobility impaired individuals to more easily enter and exit the vehicle 10. The ramp assembly 14 includes a ramp platform 22 that is pivotally coupled to a suitable surface of the vehicle 10 or other structure onto which the ramp assembly 14 is installed. The ramp platform 22 includes a substantially planar ramp surface 24, and pivots between the deployed position and stowed position about a pivot axis 26.

The ramp assembly 14 also includes a ramp extension 30 pivotally coupled to a distal end 34 of the ramp platform 22. The ramp extension 30 pivots between a retracted position when the ramp assembly 14 is in the stowed position (FIG. 2), and an extended position when the ramp assembly 14 is in the deployed position (FIG. 3). When in the retracted position, the ramp extension 30 is positioned against the ramp platform 22, thereby reducing the height of the stowed ramp assembly 14. When in the extended position, the ramp extension 30 is substantially aligned with the ramp platform 22 and extends beyond the distal end 34 of the ramp platform, thereby extending the length of the deployed ramp.

With continued reference to FIGS. 2 and 3, an arm 38 and a drive assembly 42 cooperate to move the ramp platform 22 and ramp extension 30 between the stowed and deployed positions in response to manual movement of a handle 44. The drive assembly 42 is coupled to a suitable surface of the vehicle 10 or other structure onto which the ramp assembly 14 is installed. The handle 44 is coupled to the drive assembly 42 by an actuating shaft 45. The drive assembly 42 is configured so that rotation of the actuating shaft 45 causes the arm 38 to pivot between stowed and deployed positions, as discussed further below. In the illustrated embodiment, the drive assembly 42 also defines a pivot point 46 that pivotally supports the ramp platform 22 for movement about the pivot axis 26. In other constructions, the pivot point 46 may be defined by structure that is separate from the drive assembly 42.

The arm 38 is coupled to the drive assembly 42, the ramp platform 22, and the ramp extension 30. One end of the arm 38 is pivotally coupled to the drive assembly 42 for pivotal movement about a drive axis 48 (discussed further below) that is spaced from and substantially parallel to the pivot axis 26. When in the stowed position, the arm 38 extends away from the drive assembly 42 substantially parallel to the ramp platform 22. Approximately two-thirds of its length away from the drive assembly 42, the arm 38 defines a slot 50 that receives a projection 54 extending from the ramp platform 22. The sides of the slot 50 engage the projection 54 to move the ramp platform 22 between the deployed and stowed positions when the drive assembly 42 pivots arm 38 about the drive axis 48. Because the arm 38 and the ramp platform 22 do not pivot about collinear axes, they move relative to one another as they pivot between the stowed and deployed position. The slot 50 is provided to accommodate such relative movement.

The arm 38 is coupled to the ramp extension 30 by a cable 58 that extends around a cam 62 coupled to the ramp extension 30. One end of the cable 58 is coupled to a distal end 66 of the arm 38, and the other end of the cable 58 is coupled to the cam 62. As discussed above, the arm 38 and the ramp platform 22 move relative to one another as they move toward the deployed position. Specifically, as the arm 38 and ramp platform 22 move toward the deployed position, the projection 54 moves within the slot 50 toward the distal end 66 of the arm 38. The cam 62 is therefore also moving away from the distal end 66 of the arm 38. As the cam 62 moves away from the distal end 66 of the arm 38, the cable 58 rotates the cam 62 and the ramp extension 30 relative to the ramp platform 22, thereby moving the ramp extension toward the extended position during deployment. When the ramp is stowed, the cam 62 moves back toward the distal end 66 of the arm 38, thereby reducing tension in the cable 58 and allowing gravity to move the ramp extension 30 back to the retracted position. Although the illustrated embodiment utilizes a cable and cam arrangement to move the ramp extension 30, other mechanisms including, without limitation, chains and sprockets, belts and pulleys, gear and shaft drives, and similar mechanisms may also be used.

Figure 4:
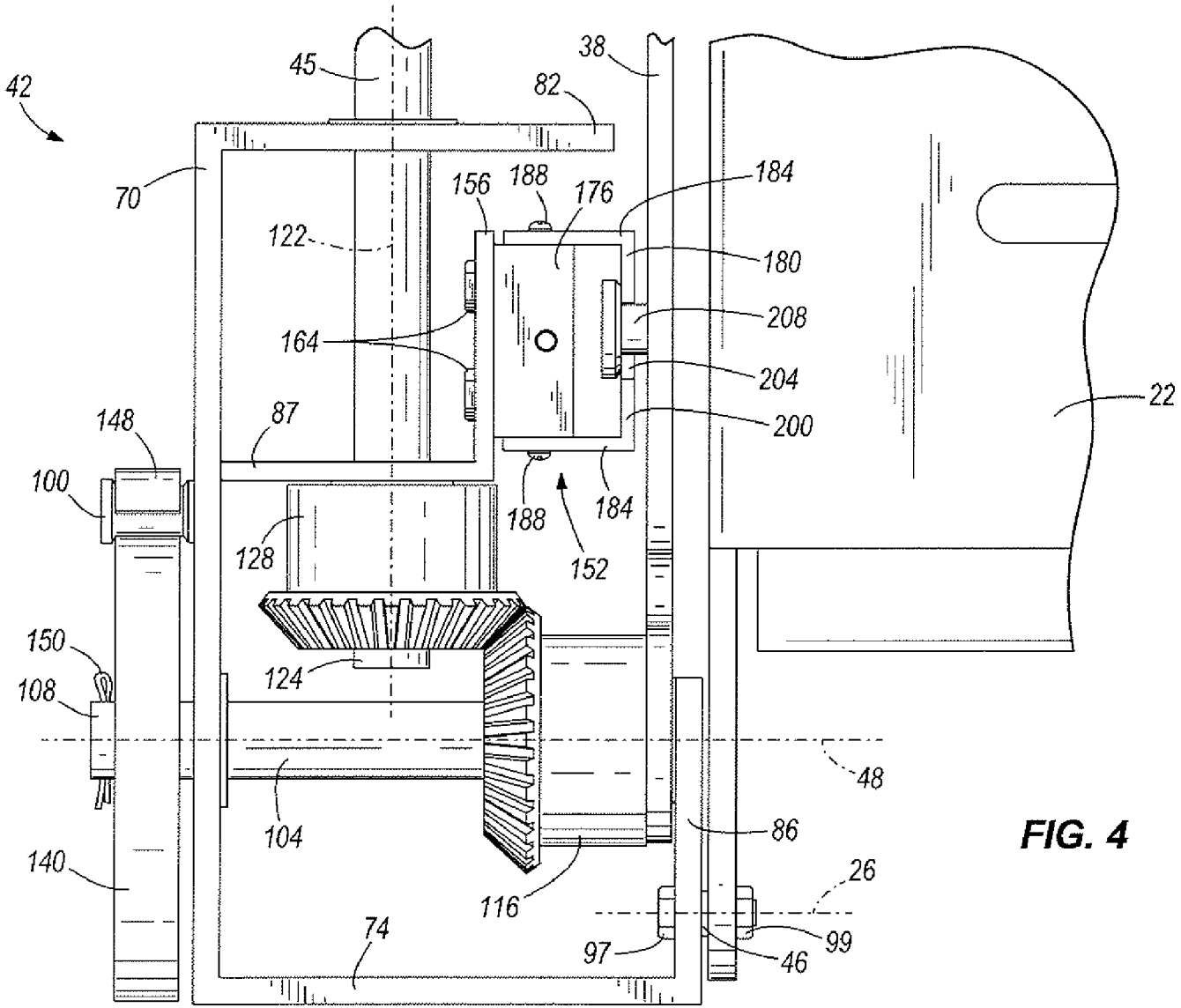
FIG. 4 is an enlarged front view of a drive assembly of the manually operated ramp assembly of FIG. 1.
Figure 5:
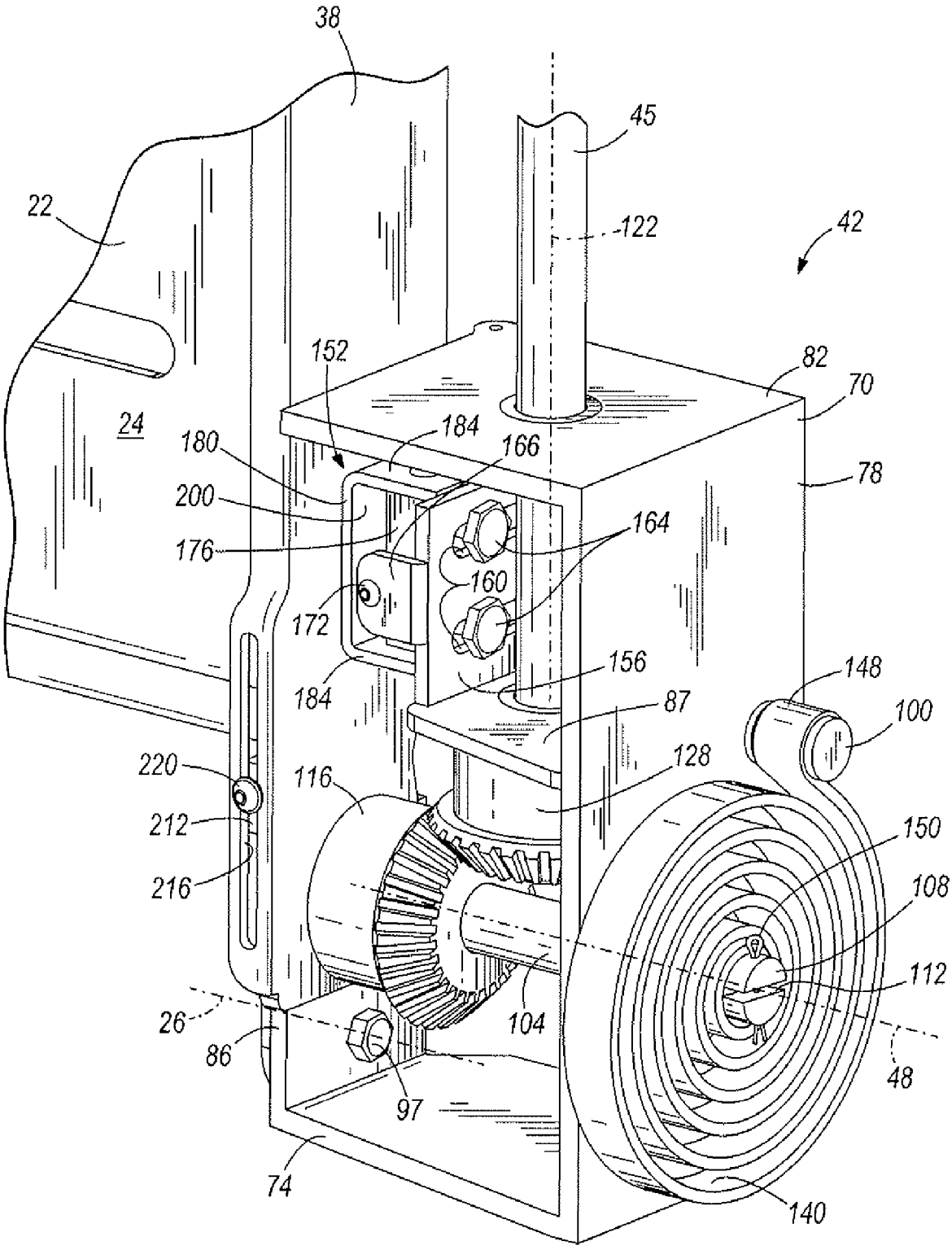
FIG. 5 is a perspective view of the drive assembly of FIG. 4.
Figure 6:
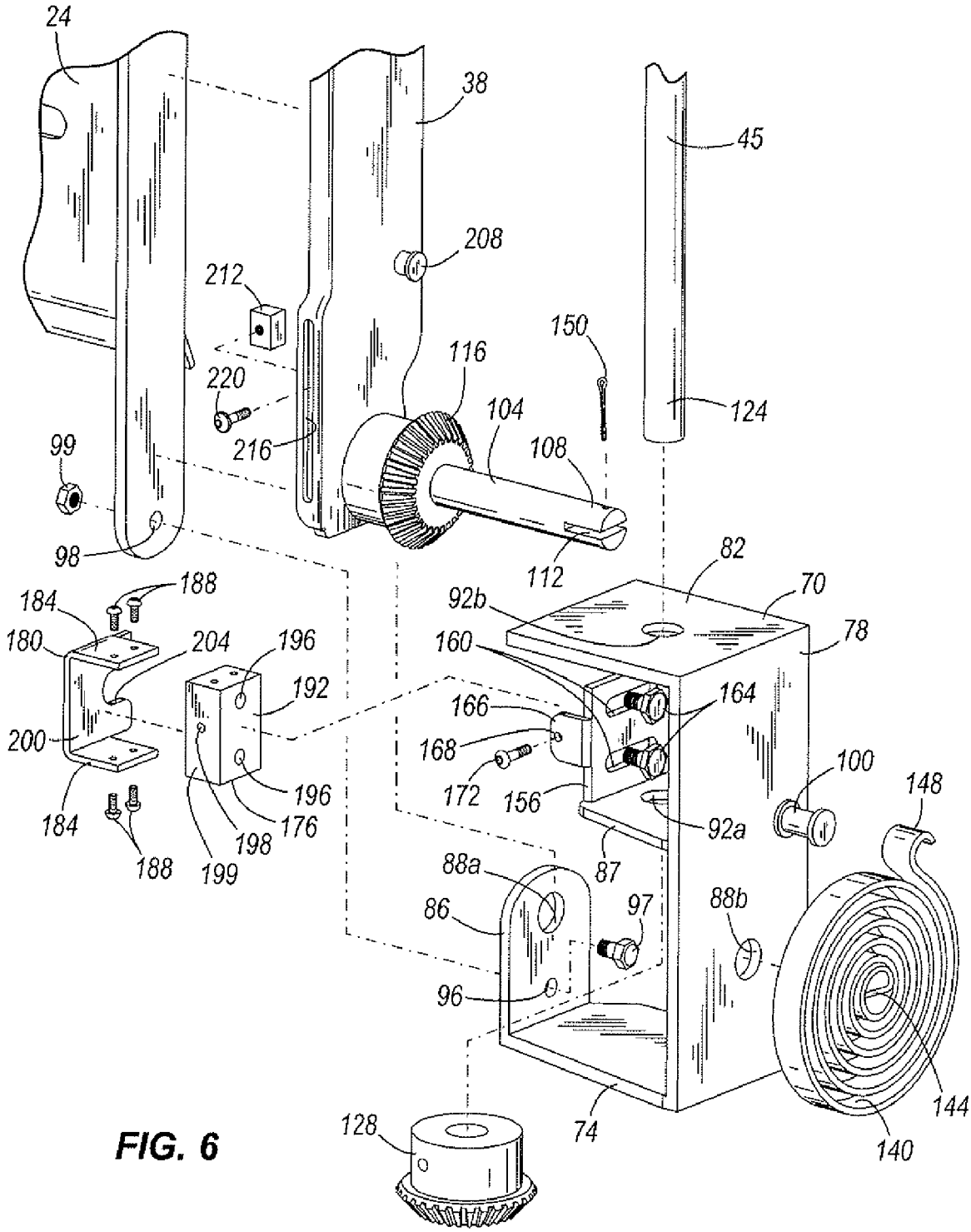
FIG. 6 is an exploded perspective view of the drive assembly of FIG. 4.

Referring also to FIGS. 4-6, the drive assembly 42 includes a housing 70 that is mounted to the surface of the vehicle 10 or other structure onto which the ramp assembly 14 is installed. The illustrated housing 70 includes a bottom wall 74, a sidewall 78, and a top wall 82. A pivot tab 86 extends generally upwardly from the bottom wall 74 opposite the sidewall 78, and a guide tab 87 extends generally inwardly from the sidewall 78 between the top and bottom walls 82, 74. A first pair of substantially aligned bores 88*a*, 88*b* are defined by the pivot tab 86 and the sidewall 78, and a second pair of substantially aligned bores 92*a*, 92*b* are defined by the guide tab 86 and the top wall 82 (FIG. 6). A stop member 100 projects outwardly from the sidewall 78 and is spaced radially from the bore 88*b*. The pivot tab 86 also defines a pivot bore 96 positioned below the bore 88*a* and partially defining the pivot point 46. A pivot bolt 97 extends through the pivot bore 96 and through an aperture 98 defined by the ramp platform 22 to pivotally couple the ramp platform 22 to the pivot tab 86. A nut 99 secures the bolt 97 and the ramp platform 22 to the pivot tab 86.

The drive assembly 42 also includes drive shaft 104 that defines the drive axis 48. Each end of the drive shaft 104 is received by one of the first pair of bores 88*a*, 88*b* for rotation about the drive axis 48. A slotted end 108 extends through the bore 88*b* in the sidewall 78 and defines a slot 112. An opposite end (hidden) extends through the arm 38 and into the bore 88*a* defined by the pivot tab 86 for support thereby. A first bevel gear 116 is mounted on the drive shaft 104 for rotation therewith. The first bevel gear 116 is also coupled to the arm 38 so that rotation of the drive shaft 104 and bevel gear 116 causes pivotal movement of the arm 38 about the drive axis 48. While a number of configurations are possible, in the illustrated construction, the bevel gear 116 is welded to both the drive shaft 104 and the arm 38. Keyed connections, non-circular cross-sections, cooperating projections and recesses, splines, adhesives, or substantially any other type of substantially fixed connection or combination of connections may also be employed to non-rotatably couple the first bevel gear 116 to the drive shaft 104 and the arm 38.

The drive assembly 42 also includes the actuating shaft 45 that extends through the second pair of bores 92*a*, 92*b* and defines a shaft axis 122. One end 124 of the actuating shaft 45 extends through the guide tab 86 and has coupled thereto a second bevel gear 128 that meshes with the first bevel gear 116. The actuating shaft 45 also extends generally upwardly from the housing 70 and terminates in a distal end 132 having the handle 44 defined by or coupled thereto (see FIG. 2). The handle 44 affords manual rotation of the actuating shaft 45 about the shaft axis 122. In some embodiments the handle 44 is positioned just above the distal end 34 of the ramp platform 22 when the ramp platform 22 is in the stowed position, which is generally at least approximately 30 inches above the pivot axis 46. This height generally allows for manual operation of the handle 44 by an operator positioned either inside or outside of the vehicle 10.

The one end 124 of the actuating shaft 45 is coupled to the second bevel gear 128 so that the actuating shaft 45 and second bevel gear 128 rotate together. This may be accomplished by substantially any suitable coupling method, including a keyed connection, splined connection, non-circular cross sections, welding, adhesives, pins, set screws, fasteners, and the like. Thus, manual rotation of the handle 44 about the shaft axis 122 rotates the actuating shaft 45 which rotates the second bevel gear 128. Rotation of the second bevel gear 128 in turn causes rotation of the first bevel gear 116 which then rotates the drive shaft 104 and pivots the arm 38 about the drive axis 48 to move the ramp platform 22 between the stowed and deployed positions.

The drive assembly 42 also includes a biasing member 140 coupled to the slotted end 108 of the drive shaft 104 and to the stop member 100 of the housing sidewall 78. In the illustrated construction, the biasing member 140 is in the form of a torsional clock spring having an inner end that defines a tab 144 and an outer end that defines a hook 148. The inner end is coupled to the slotted end 108 of the drive shaft 104 by inserting the tab 1 44 into the slot 112. In the illustrated embodiment, a cotter pin 150 is inserted through a small bore in the slotted end 108 to secure the biasing member 140 on the drive shaft 104. Of course other methods of securing the biasing member 140 to the drive shaft 104 including nuts, bolts, snap rings, c-clips, e-clips and the like may also be employed.

The outer end of the biasing member 140 is coupled to the stop member 100 by positioning the hook 148 around the stop member 100. In some embodiments, positioning the hook 148 around the stop member 100 includes pre-loading the biasing member. In the illustrated embodiment this includes rotating the hook 148 with respect to the tab 144 in a counterclockwise direction as viewed in FIGS. 5 and 6. In some embodiments, pre-loading the biasing member is done when the ramp assembly 14 is in the stowed position so that the biasing member 140 biases the arm 38 against a stop assembly 152 (discussed below) when the ramp assembly 14 is in the stowed position, thereby reducing movement and rattling of the r amp assembly 14 during operation of the vehicle 10.

The drive assembly 42 also includes the stop assembly 152. The stop assembly 152 includes a stop plate 156 that extends generally upwardly from the distal end of the guide tab 87. The stop plate 156 defines a pair of substantially parallel slots 160 that extend substantially parallel to the top and bottom walls 82, 74. Each slot 160 slidingly receives a respective lock bolt 164. The stop plate 156 also includes an adjustment tab 166 oriented substantially perpendicular to the longitudinal extent of the slots 160, and that defines a bore 168. An adjustment screw 172 extends through the bore 168.

The stop assembly 152 also includes an adjustment block 176 and a stop bracket 180. The adjustment block 176 is a cuboid and the stop bracket 1 80 is substantially C-shaped and receives the adjustment block 176. In the illustrated construction, leg portions 184 of the stop bracket 180 are coupled to top and bottom surfaces of the adjustment block 176 by fasteners 188, however, numerous other methods for connecting the stop bracket 180 and adjustment block 1 76 may also or alternatively be employed. A side surface 192 of the adjustment block 176 defines a pair of threaded bores 196 that receive the lock bolts 164. The adjustment block 176 also includes an end surface 199 that faces the adjustment tab 166. A threaded bore 198 extends through the end surface 199 and receives the adjustment screw 172.

A central portion 200 of the stop bracket 180 defines a slot 204 that opens generally in the direction of ramp deployment. The slot 204 is configured to receive a projection 208 that extends laterally from the arm 38 when the ramp assembly 14 is in the stowed position. Engagement between the projection 208 and the slot 204 limits movement of the arm 38 toward the stowed position. To reduce rattling or noise during operation of the vehicle 10, the projection 208 may be formed of a plastic, rubber, or high density polymer, or covered with a sleeve formed of such materials. Similarly, a compensator block 212 formed of the same materials is coupled to the arm 38 for engagement with both the arm 38 and the ramp platform 22 when the ramp assembly 14 is in the stowed position. The compensator block 212 can be selectively positioned along a slot 216 defined by the arm 38 by loosening and tightening an adjustment fastener 220.

To accommodate imperfections or irregularities in the surface of the vehicle or other structure onto which the ramp assembly 14 is mounted, the stop assembly 152 is adjustably coupled to the housing 70. When the lock bolts 164 are tightened, the adjustment block 176 and stop bracket 180 are substantially fixed with respect to the stop plate 156 and housing 70. However, when the lock bolts 164 are loosened, the lock bolts 164 may be moved within the slots 160 to adjust the position of the adjustment block 176 and stop bracket 180 relative to the stop plate 156 and housing 70. Lateral movement of the adjustment block 176 relative to the stop plate 156 can be controlled by rotating the adjustment screw 172, which is threaded into the threaded bore 198 of the adjustment block 176. A lock nut (not shown) is threaded on the adjustment screw 172 and positioned between the adjustment tab 166 and the adjustment block 176. The lock nut prevents rotation of the adjustment screw 172 once adjustments to the adjustment block 176 have been made.

Figure 7:
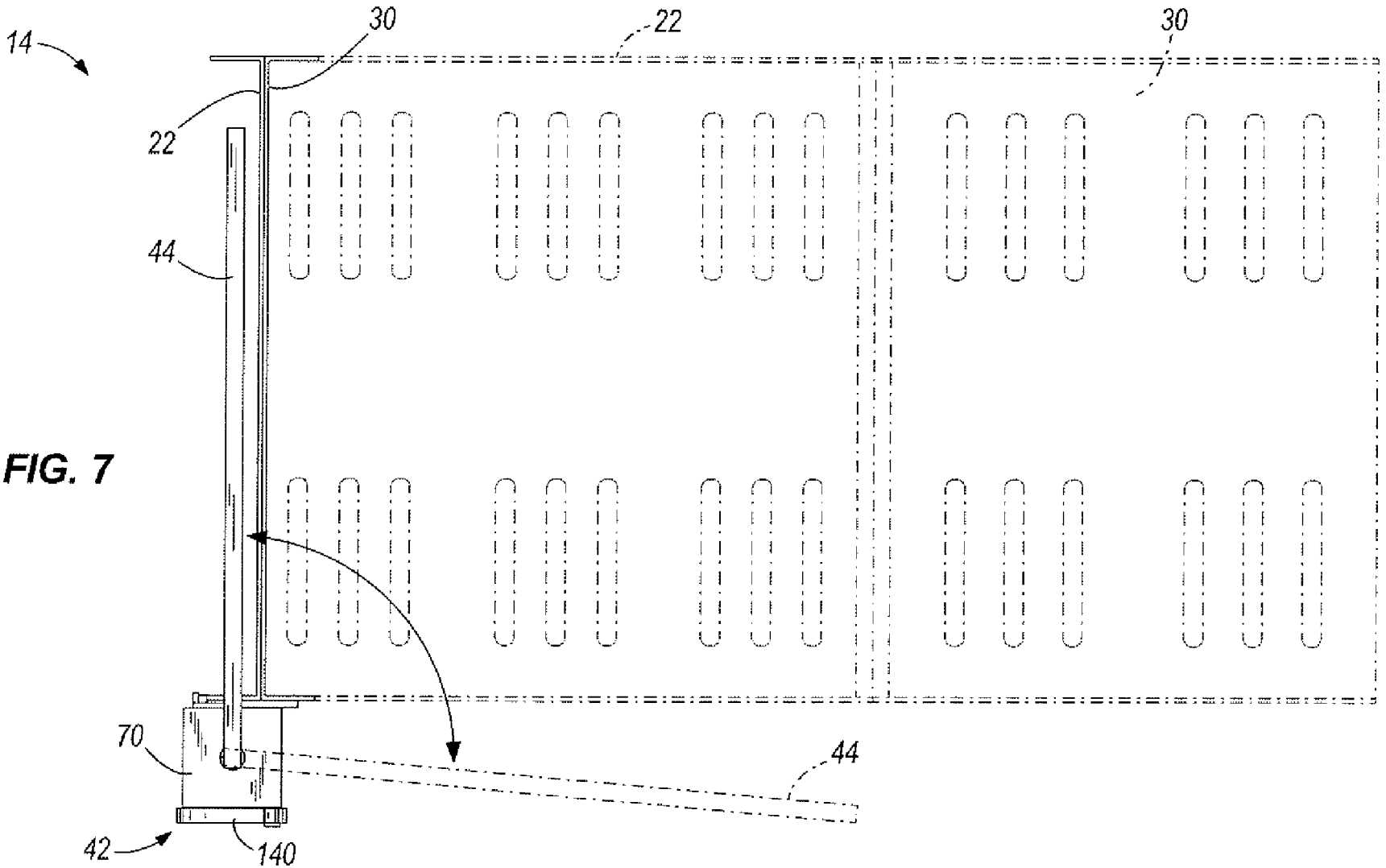
FIG. 7 is a top view of the manually operated ramp assembly with the ramp assembly illustrated in a deployed position in phantom.

With reference also to FIG. 7, to move the ramp assembly 14 from the stowed position (FIG. 2) to the deployed position (FIG. 3), an operator manually moves the handle 44 from a first postion, shown in solid in FIG. 7, to a second position shown in phantom in FIG. 7. Movement of the handle 44 in this manner rotates the actuating shaft 45 about the shaft axis 122, which in turn rotates the second bevel gear 128. The second bevel gear 128 then rotates the first bevel gear and the drive shaft 104 in a counter-clockwise direction as viewed in FIG. 5. This rotation of the drive shaft 104 moves the arm 38 from the stowed position toward the deployed position while also rotating the inner end tab 144 of the biasing member 140 clockwise with respect to the outer end hook 148 (again, as viewed in FIG. 5), thereby increasing the tension in the biasing member 140.

As discussed above, in some constructions the biasing member 140 is pre-loaded to bias the arm 38 against the stop assembly 152 when the ramp assembly is in the stowed position. In this regard, initial movement of the handle 44 when the ramp assembly 14 is in the stowed position must overcome the biasing force provided by the pre-loading of the biasing member 140. Once movement of the ramp is initiated, as the ramp platform 22 moves toward the deployed position, the torque about the drive axis 48 as a result of gravity acting on the ramp platform 22 increases. As discussed above, rotation of the drive shaft 104 during ramp deployment also tightens the biasing member, which in turn more forcefully biases the ramp platform 22 toward the stowed position. Thus, as the ramp platform 22 moves toward the deployed position, the increase in torque due to the weight of the ramp platform 22 is counter acted by the increasing biasing force provided by the biasing member 140. In this way, the biasing member 140 reduces both the magnitude and the variability of the manual force that must be applied to the handle while moving the ramp platform 22 from the stowed to the deployed position.

The biasing member 140 similarly reduces the magnitude and variability of the manual force applied to the handle 44 during movement of the ramp assembly 14 from the deployed position to the stowed position. As the ramp platform 22 moves from the deployed position to the stowed position, the torque about the drive axis 48 due to gravity is gradually reduced. As the drive shaft 104 rotates in a counter-clockwise direction (as viewed in FIG. 5) the tension in the biasing member 140 is also reduced. In those constructions in which the biasing member 140 is pre-loaded to bias the arm 38 against the stop member 152, once the ramp platform 22 is sufficiently near the stowed position the biasing force of the biasing member 140 may itself be sufficient to move the ramp platform 22 fully to the stowed position, requiring no additional force on the handle 44 by an operator.

The first and second bevel gears 116, 128 illustrated in FIGS. 2-7 provide a gear ratio of substantially 1:1. As such, when the ramp assembly 14 is between the stowed and deployed positions, the arc traveled by the handle 44 is substantially the same as the arc traveled by the ramp platform 22. For example, when the ramp platform 22 moves from the stowed position (generally substantially vertical) to the deployed position (generally angled slightly downwardly), the ramp platform 22 travels through an arc of slightly more than 90 degrees. As illustrated in FIG. 7, the 1:1 ration of the first and second bevel gears 116, 128 results in the handle 44 similarly moving through an arc of slightly more than 90 degrees.

Figure 8:
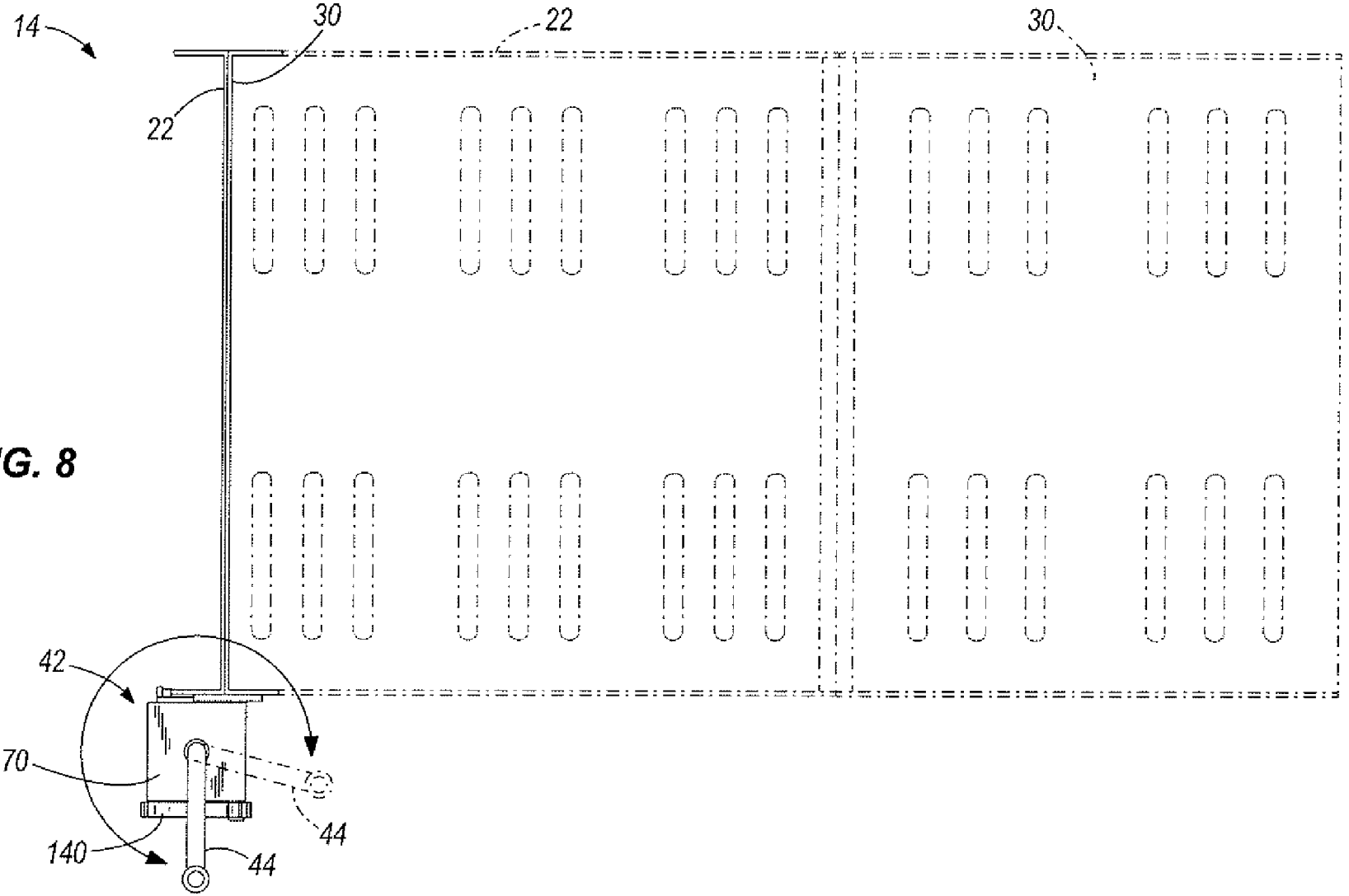
FIG. 8 is a top view of an alternative embodiment of the manually operated ramp assembly with the ramp assembly illustrated in a deployed position in phantom.

With reference to FIG. 8, in some constructions the gear ratio between the first and second bevel gears 116, 128 may be altered to provide a mechanical advantage at the actuating shaft 45, thereby reducing the amount of torque that must be applied to the actuating shaft 45 via the handle while moving the ramp assembly 14 between the stowed and deployed positions. The ramp illustrated in FIG. 8 has a first bevel gear 116 coupled to the drive shaft 104 that is smaller than the second bevel gear 128 coupled to the actuating shaft 45 to provide a gear ratio of approximately 3:1. As a result, movement of the ramp platform 22 through slightly more than 90 degrees of travel results in movement of the handle 44 through slightly more than 270 degrees of travel. Because of the mechanical advantage provided by the first and second bevel gears 116, 128 in the ramp assembly 14 of FIG. 8, the length of the handle 44 may also be reduced, as illustrated. While substantially any gear ratio can be selected, ratios that do not require more than 360 degrees of handle rotation to move the ramp platform 22 between the stowed and deployed positions are preferred.

What is claimed is:

1. A manually operated ramp assembly comprising:

a ramp platform moveable between a stowed position and a deployed position;

a drive assembly coupled to the ramp platform and operable to move the ramp platform;

a shaft defining a shaft axis, the shaft coupled to the drive assembly to cause movement of the ramp platform between the stowed position and the deployed position in response to rotation of the shaft about the shaft axis;

a handle coupled to the shaft for manual rotation of the shaft about the shaft axis; and a biasing member biasing the ramp platform toward the stowed position, wherein the drive assembly includes a drive shaft coupled to the ramp platform and extending substantially perpendicularly to the shaft axis, and wherein the drive shaft is coupled for rotation with the shaft by a set of bevel gears.

2. The ramp assembly of claim 1 wherein the ramp is moveable from one of the deployed position and the stowed position to the other of the deployed position and the stowed position in response to less than 360 degrees of rotation of the shaft about the shaft axis.

3. The ramp assembly of claim 1 wherein the drive assembly includes a housing, and wherein the biasing member includes a torsion spring having a first end coupled to the drive shaft and a second end coupled to the housing.

4. The ramp assembly of claim 1 wherein the ramp platform moves between the stowed position and the deployed position in a plane that is substantially parallel to the shaft axis.

5. The ramp assembly of claim 1 wherein the drive assembly includes a drive shaft defining a drive axis extending substantially perpendicularly to the shaft axis, the drive shaft coupled to the shaft for rotation therewith, and wherein the ramp platform pivots about a pivot axis that is spaced from and substantially parallel to the drive axis.

6. The ramp assembly of claim 5 further comprising:

an arm having one end coupled to the drive shaft for rotation therewith, and an opposite end coupled to the ramp platform; and a ramp extension pivotally coupled to a distal end of the ramp platform, the ramp extension moving between an extended position and a retracted position in response to movement of the ramp platform between the deployed position and the stowed position, the ramp extension coupled to the arm and moving between the extended position and the retracted position in response to relative movement between the arm and the ramp platform.

7. The ramp assembly of claim 5 wherein the handle is spaced at least thirty inches above the pivot axis.

8. A manually operated ramp assembly comprising:

a ramp platform moveable between a stowed position and a deployed position, the ramp platform having a substantially planar ramp surface and moveable in a ramp plane that is substantially normal to the ramp surface;

a drive assembly coupled to the ramp platform and operable to move the ramp platform between the stowed position and the deployed position;

a shaft defining a shaft axis that is substantially parallel to the ramp plane, the shaft coupled to the drive assembly to cause movement of the ramp platform between the stowed and deployed positions in response to rotation of the shaft about the shaft axis;

a handle coupled to the shaft for manual rotation of the shaft about the shaft axis; and a biasing member biasing the ramp platform toward the stowed position, wherein the ramp platform pivots about a pivot axis that is substantially normal to the ramp plane, the ramp assembly further comprising an arm having a first end coupled to the drive assembly and a second end coupled to the ramp platform, the first end pivoting about a drive axis in response to rotation of the shaft about the shaft axis to move the ramp platform.

9. The ramp assembly of claim 8 wherein the ramp platform is moveable from one of the deployed position and the stowed position to the other of the deployed position and the stowed position in response to less than 360 degrees of rotation of the shaft about the shaft axis.

10. The ramp assembly of claim 8, wherein the second end is slideably coupled to the ramp platform, and wherein the drive axis is spaced from and substantially parallel to the pivot axis.

11. The ramp assembly of claim 8, wherein the drive axis and the shaft axis are substantially perpendicular, wherein the drive assembly includes a drive shaft substantially aligned with the drive axis, and wherein the drive shaft is coupled for rotation with the shaft by bevel gears.

12. The ramp assembly of claim 11, wherein the bevel gears are selected to provide a gear ratio for rotation of the shaft relative to the drive shaft in the range of about 1:1 to 3:1.

13. The ramp assembly of claim 11, wherein the pivot assembly includes a housing, and wherein the biasing member is a torsion spring having a first end coupled to the drive shaft and a second end coupled to the housing.

14. A manually operated ramp assembly comprising:

a ramp platform having a distal end and a substantially planar ramp surface, the ramp platform movable between a stowed position in which the ramp surface is substantially vertical, and a deployed position;

a drive assembly coupled to the ramp platform and operable to move the ramp platform between the stowed position and the deployed position;

a shaft extending substantially vertically upwardly from the drive assembly and beyond the distal end of the ramp platform when the ramp platform is in the stowed position, the shaft defining a shaft axis and coupled to the drive assembly to cause movement of the ramp platform between the stowed and deployed positions in response to rotation of the shaft about the shaft axis;

a handle disposed at an end of the shaft for manual rotation of the shaft about the shaft axis, the handle positioned above the distal end of the ramp platform when the ramp platform is in the stowed position; and a biasing member biasing the ramp platform toward the stowed position.

15. The ramp assembly of claim 14, wherein the ramp platform is moveable from one of the deployed position and the stowed position to the other of the deployed position and the stowed position in response to less than 360 degrees of rotation of the shaft about the shaft axis.

16. The ramp assembly of claim 14, wherein the handle defines a handle axis, and wherein when the ramp platform is in the stowed position, the handle axis is substantially parallel to the ramp surface.

17. The ramp assembly of claim 14, wherein the drive assembly includes a drive shaft coupled to the ramp platform and extending substantially perpendicularly to the shaft axis, the drive shaft coupled for rotation with the shaft.

18. The ramp assembly of claim 17, further comprising an arm coupled to the drive shaft and to the ramp, and wherein the drive shaft defines a drive axis and the ramp pivots about a ramp axis that is spaced from and substantially parallel to the drive axis.

* * * * *